US008196494B2

(12) United States Patent
Brovold

(10) Patent No.: US 8,196,494 B2
(45) Date of Patent: Jun. 12, 2012

(54) ATTACHMENT SYSTEM FOR RATCHET TYPE WRENCHES

(75) Inventor: Thomas Emil Brovold, Barns, WI (US)

(73) Assignee: Spinzit Tools LLC., Barnes, WI (US)

( * ) Notice: Subject to any disclaimer, the term of this patent is extended or adjusted under 35 U.S.C. 154(b) by 372 days.

(21) Appl. No.: 12/545,150

(22) Filed: Aug. 21, 2009

(65) Prior Publication Data

US 2010/0282027 A1 Nov. 11, 2010

Related U.S. Application Data

(60) Provisional application No. 61/176,568, filed on May 8, 2009.

(51) Int. Cl.
*B25B 13/00* (2006.01)

(52) U.S. Cl. ..... 81/58.1; 81/57.3; 81/58

(58) Field of Classification Search ..... 81/57.3, 81/58.1

See application file for complete search history.

(56) References Cited

U.S. PATENT DOCUMENTS

| | | | | |
|---|---|---|---|---|
| 835,034 | A | 11/1906 | Riddle | |
| 2,421,038 | A | 5/1947 | Schultz | |
| 2,603,998 | A | 7/1952 | Schwartz | |
| 2,678,577 | A | 5/1954 | Tackett | |
| 2,817,256 | A | 12/1957 | Malone et al. | |
| 3,283,621 | A | 11/1966 | Faso | |
| 4,184,390 | A * | 1/1980 | Evans | 81/57.3 |
| 4,436,003 | A | 3/1984 | Cox | |
| 4,491,042 | A | 1/1985 | Lopochonsky | |
| 4,867,016 | A * | 9/1989 | Di Edwardo | 81/57.3 |
| 5,144,869 | A | 9/1992 | Chow | |
| D332,730 | S | 1/1993 | Usuda | |
| 5,390,570 | A | 2/1995 | Reisner | |
| 5,461,949 | A | 10/1995 | Carver | |
| 5,540,122 | A | 7/1996 | Lund | |
| 6,193,624 | B1 * | 2/2001 | Lund | 474/203 |
| 6,318,216 | B1 | 11/2001 | Eggert et al. | |
| 6,647,830 | B2 | 11/2003 | Marquardt | |
| 7,320,267 | B1 * | 1/2008 | Chen | 81/58.1 |
| 7,331,259 | B1 | 2/2008 | Chen | |

(Continued)

FOREIGN PATENT DOCUMENTS

WO WO2008123773 10/2008

*Primary Examiner* — Joseph J Hail
*Assistant Examiner* — Shantese McDonald
(74) *Attorney, Agent, or Firm* — Larkin Hoffman Daly & Lindgreen Ltd.; Craig J. Lervick

(57) ABSTRACT

A drive system cooperating with the drive mechanism of a ratchet wrench enables a user to use the wrench for its intended purpose and also spin the drive at high speed by pulling an endless belt. The belt is contained in a manner which causes structures on the belt to engage with exposed gear teeth of the ratchet wrench or an attachment. The containment structure provides for proper alignment and positioning of the belt to allow for the desired engagement with the drive teeth even after the user releases grip from the belt. The containment structure further allows an opposite end of the belt to hang loose and thus be easily accessible by a user. The drive system can be used on a socket ratchet without exposed teeth by adding gear teeth to a ratchet drive member or socket either permanently, as an added part or as an extension to the socket ratchet or socket.

25 Claims, 10 Drawing Sheets

U.S. PATENT DOCUMENTS

| | | | |
|---|---|---|---|
| D566,496 | S | 4/2008 | Hsien |
| D566,497 | S | 4/2008 | Wang |
| D577,271 | S | 9/2008 | Ganz et al. |
| D580,720 | S | 11/2008 | Shiao |
| D586,634 | S | 2/2009 | Lai |
| 2005/0211026 | A1 | 9/2005 | Cheng |

* cited by examiner

ATTACHMENT SYSTEM FOR RATCHET TYPE WRENCHES

RELATED APPLICATIONS

This application claims the benefit of previously filed U.S. Provisional application 61/176,568, filed May 8, 2009 and entitled "Attachment System for Ratchet Type Wrenches".

BACKGROUND

The invention generally relates to mechanisms that remove and install nuts, bolts and other fasteners. More specifically, the embodiments described below provide tools and methods for the high speed installation or removal of fasteners.

Ratchet mechanisms are typically used to cause the small forceful angular rotation of a fastener, and then rotate the handle in reverse without rotating the fastener. By allowing for this repeated rotational motion, a user can easily remove a fastener without taking the wrench on and off. This ratcheting function is typically achieved by appropriately engaging and disengaging a ratcheting mechanism (such as a gear with teeth and a pawl interacting with the gear teeth in a desired manner). In several applications the available amount of rotation is very small due to physical constraints (e.g. working in tight spaces). This demands numerous back and forth angular rotations enabled by the ratchet mechanisms. In some cases, a full revolution may take up to 72 back and forth ratchet motions. More typically, an application may allow about 4-5 back and forth rotations per revolution. Given that a fastener typically requires several threads to be engaged and often includes additional threads for starting the fastener, removal with a standard socket wrench can often require many back and forth motions. This can result in approximately a minute to remove or install a single fastener. This slow speed can be an annoying and troublesome characteristic of ratchet wrenches, especially for mechanics or other individuals who deal with these type of fasteners many times throughout their day.

Often, when using a ratchet mechanism the fastener is very loose for most of the removal or installation operation. In these circumstances, the user must grasp the drive head to prevent it from turning backwards without ratcheting over the gear. This is an additional annoying characteristic of ratchet mechanisms.

There have been numerous previously developed devices for turning of a fastener using alternative motions. For example, certain devices incorporate the cranking or twisting motion of a handle portion, which is then translated into dive head rotation of a socket wrench. Similar approaches or methods do not presently exist for the box end ratchet wrenches or typical socket wrenches. Generally, prior approaches to this problem of fast spinning fasteners have all included rather complex and expensive mechanisms to create the necessary motion. As such, there is a need for a simple mechanism that allows for the faster spinning of fasteners which utilizes the existing structures of box end wrenches or socket wrenches.

SUMMARY

One simple but elegant solution which addresses the above discussed problem uses a flexible belt appropriately attached to either a portion of a wrench or a related wrench attachment. The sizing and configuration of the belt provides for engagement on only one end of the wrench while allowing the remainder of the belt to hang loose. This is contrary to the typical approach which includes the need to stretch the belt over two wheels in order to maintain tooth engagement. By wrapping the belt over only one end of the wrench however, makes it necessary to include other components which hold the belt in contact with the gear teeth on that end of the wrench. Several methods may be utilized to do this, but may require modification of the tool.

A common box-end ratchet wrench typically has an exposed gear on each end. These gears allow the wrench to be easily converted to a very high speed tool that eliminates the need for continuous back and forth motion often necessary to remove or install a fastener. By holding a belt over one of the gears, fast rotation can be accomplished very easily by pulling on a loose "half" of the continuous belt. In this manner, a user can achieve multiple rotations of the fastener in a very short period of time.

Keeping the teeth of the exposed gear engaged with the belt, without having the belt fall off or loosen, is a challenge. This is generally solved by placing an elastic or similar holding band over the belt and the end of the tool, thereby containing the belt. Keeping the belt engaged can be a challenge however, due to the rapid movement of the belt. Specifically, the lateral forces caused by pulling on the belt can tend to dislodge the elastic band. To allieviate this problem, a raised surface or other type of interfering structure is created on the ratchet wrench to stop the elastic band from moving away from it's neutral position around the ratchet. One approach to creating this raised surface is the inclusion of an elastic band, or rubber band around the neck of the wrench. This addition enables the conversion of a typical box-end ratchet wrench into a high speed tool that will be usable in very tight quarters.

The "belt concept" generally described above can be applied to many different wrenches. As suggested, the box-end ratchet wrench has exposed gear teeth on the end which makes this an attractive candidate. In the case of a dual sided or two end wrench, gear teeth will be exposed on each end. Wrapping a belt over one set of these gear teeth, causing engagement between the teeth and the belt, creates a valuable high speed tool. To use the opposite end, the belt is simply repositioned over the gear teeth at the other end.

The same "belt" concept discussed above can be utilized with many different wrenches or alternative tools. In some cases, modifications or adaptations are necessary. In further cases, additional adapters for components are necessary. For example, by adding a gear wheel attachment to the drive of a standard socket wrench will result in the easy conversion to a high speed tool. The gear wheel attachment can be configured to take up little working space, and continue to accommodate the attachment of a sockets to the socket wrench drive in a traditional manner. As another alternative a standard socket wrench can be designed to have exposed gears on a top end, very similar to the box end ratchet wrenches discussed above. With this modification, the socket wrench can be easily adapted for a high speed operation in a manner very similar to that disclosed with relation to the box end ratchets mentioned above.

BRIEF DESCRIPTION OF THE DRAWINGS

Further objects and advantages of the present invention can be seen by reading the following detailed description in conjunction with the drawings in which.

DETAILED DESCRIPTION OF THE VARIOUS EMBODIMENTS

Generally speaking, one aspect of the present invention involves the use of a belt specifically designed to engage with a drive mechanism to convert a standard ratchet wrench into a high speed tool. This aspect typically requires the belt to have some engaging structure thereon, which mates or meshes with a similar engaging structure in the wrench. As will be further discussed below however, the engagement does not necessarily require the close meshing of components (i.e. the teeth of the belt and the teeth of the drive structure do not have to match). In addition to the belt, some holding structure is necessary to maintain a level of engagement at the drive end, while also allowing the free end of the belt to be accessible by the user. By combining these various aspects of the invention an efficient and effective tool is created which provides for high speed operation not available with other devices.

Figure 1:
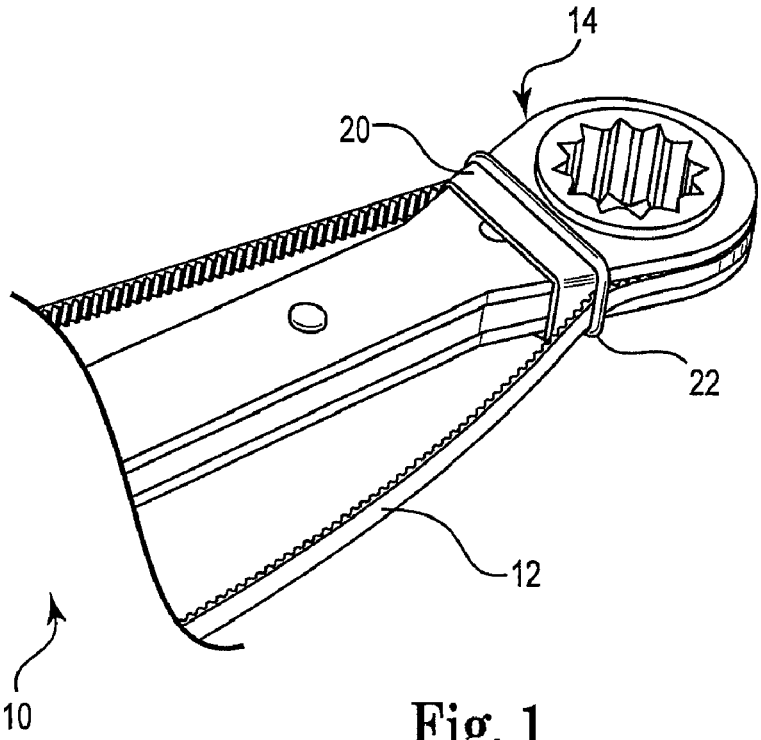
FIG. 1 provides a perspective view of the attachment system utilized on a box end ratchet wrenches.

As suggested above, it is necessary to contain or hold the belt in place to maintain engagement with the wrench gear teeth. As illustrated in FIG. 1, one embodiment of the invention utilizes a first holding band 20 placed in close contact with a body portion 14 of a wrench 10. First holding band 20 is preferably made of rubber or some similar substance, thereby creating a considerable amount of friction with body portion 14. Also attached to wrench 10 is a second holding band 22, which is specifically selected to have a low friction surface structure. As illustrated, belt 12 will be position on top of first holding band 20, while being positioned below second holding band 22. This combination of first holding band 20 and second holding band 22 allows belt 12 to be pulled and consequently slide without being pulled off wrench 10.

The appropriate sizing and configuration of the two holding bands (20 and 22) create a unique holding mechanism. Due to the materials making up first holding band 20, it will generally stay positioned on wrench body 14. As shown, this positioning will not interfere with general operation of wrench 10. In addition, the make-up of second holding band 22 will contain belt 12 while also allowing movement. In one embodiment, second holding band 22 will have a fabric outer layer, thereby establishing the desired low amount of friction. Second holding band 22 is positioned "above" first holding band 20 however, thus preventing it from sliding "down" the body of the wrench. Thus, the cooperation of the two holding bands efficiently holds belt in engagement with the gear teeth of wrench 10.

Figure 2:
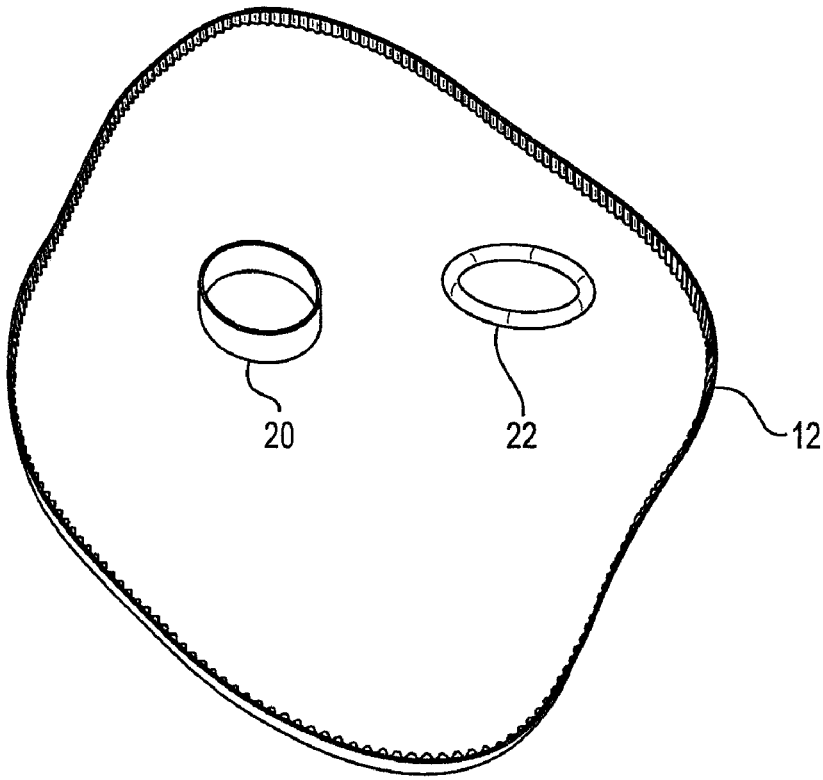
FIG. 2 illustrates the primary components making up the attachment system.

The general configuration of belt 12, first holding band 20 and second holding band 22 are shown in FIG. 2. Generally speaking, belt 12 is configured for appropriately engaging with gear teeth on a desired wrench. In this case, close engagement (e.g. having teeth on both belt 12 and gear specifically designed to closely fit with one another) is not necessary or contemplated in all circumstances. Rather, a general interfering structure is contemplated which creates a level of friction capable of driving the wrench. Further, first holding band 20 is intended to be securely attached to the body of a wrench. Lastly, second holding band 22 is intended to hold belt 12 in a desired "engagement" position, while also allowing appropriate sliding.

As mentioned above, first holding band 20 may be an elastic band of some type. In certain situations other materials may be desired to manage wear that may result from belt 12 sliding along the surface of first holding band 20. This may be further exaggerated by the teeth of belt 12 degrading the surface. As such, a more wear resistant material may be desired in these circumstances. That said, the wear on first holding belt 20 must be balanced with the ease of attachment and its ability to hold position. As such, different materials may be appropriate for different applications.

Figure 3:
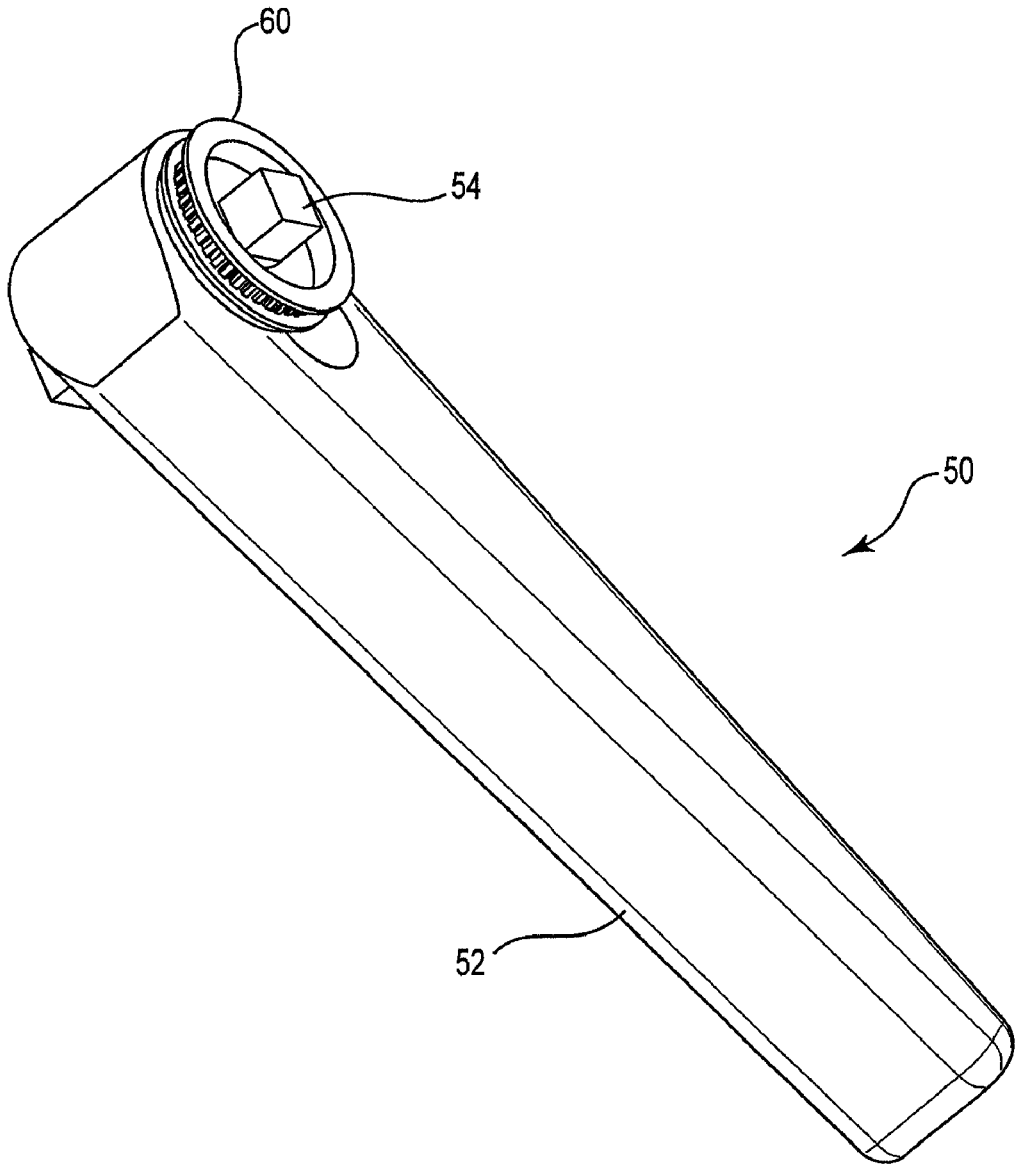
FIG. 3 illustrates one embodiment of a ratchet wrench having a gear wheel attachment.

FIG. 3 illustrates another method of implementing the belt feature on various wrenches. Thousands of socket wrenches are used every day around the world. These socket wrenches exist in many different formats, but all generally have a drive shaft of some type. Most commonly, the drive shaft has a square cross section, and is specifically designed for attachment to various sockets. FIG. 3 illustrates one such socket wrench. Generally speaking, wrench 50 has a handle portion 52 and a drive shaft 54 extending from one end. A ratcheting mechanism (not shown) is contained within wrench 50 to achieve the ratcheting function. FIG. 3 also illustrates a pulley 60, attached to drive shaft 54. As better illustrated in FIG. 4, pulley 60 is generally disc shaped and includes a square aperture 62 in a central portion thereof. A groove 64 exists on a outer circumferential edge 66. The bottom portion of groove 64 includes teeth or gear-like structures 68 which are designed to interact with a belt. Lastly, pulley 60 further includes a central recess 70 in one side. As discussed below, central recess accommodates attachment of sockets when wrench 50 is used.

Figure 5:
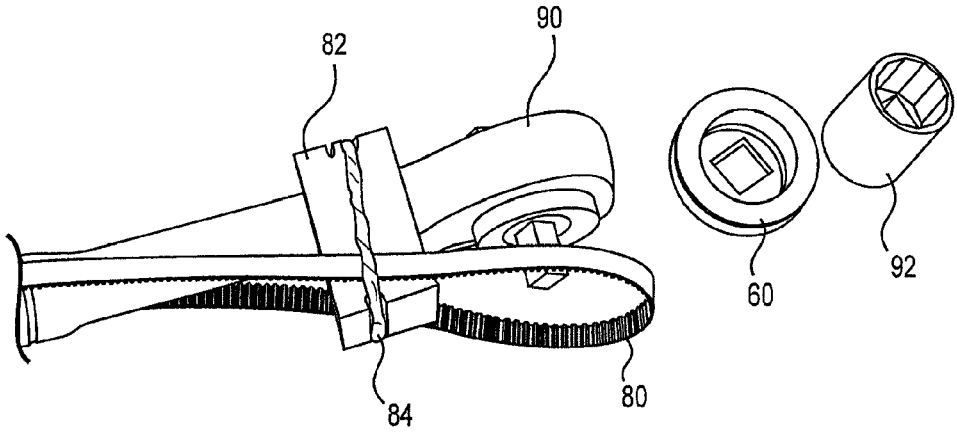
FIGS. 5 & 6 forms an exploded view of the component parts utilizing a gear wheel attachment and a standard socket wrench.
Figure 6:
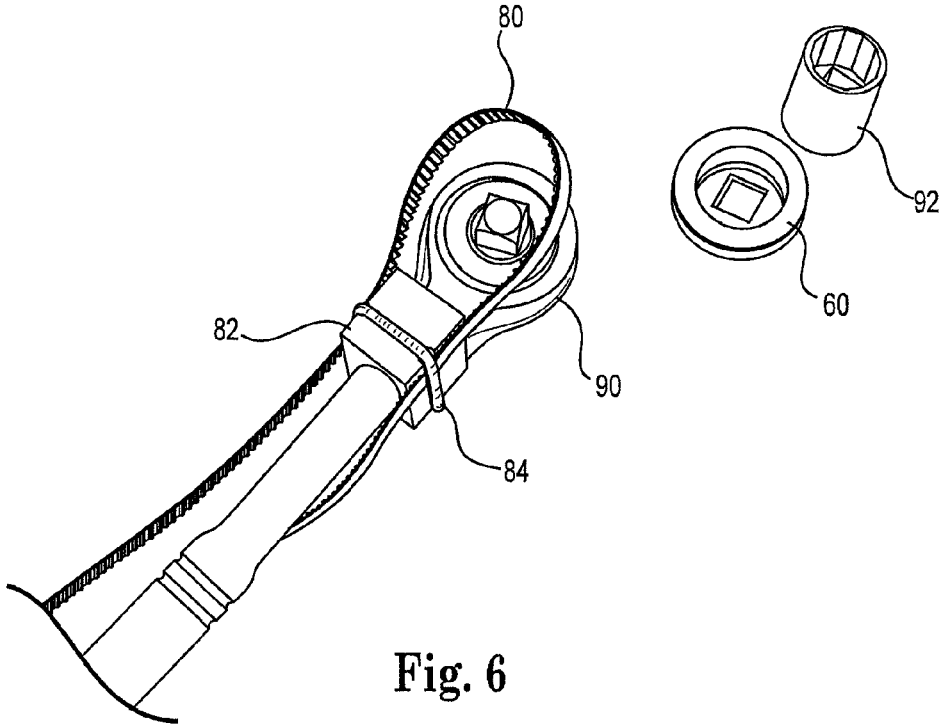
Figure 7:
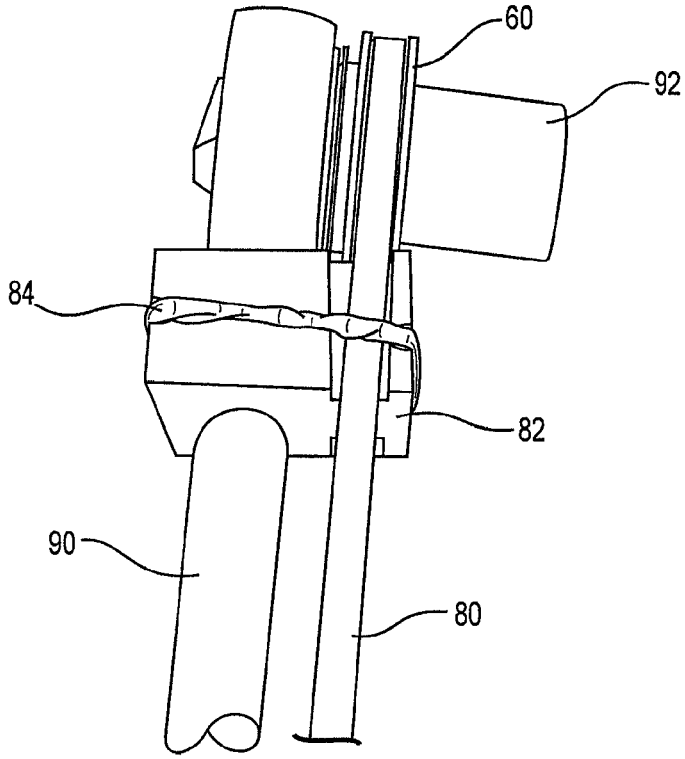
FIGS. 7 & 8 illustrate another embodiment of the gear wheel attachment concept.
Figure 8:
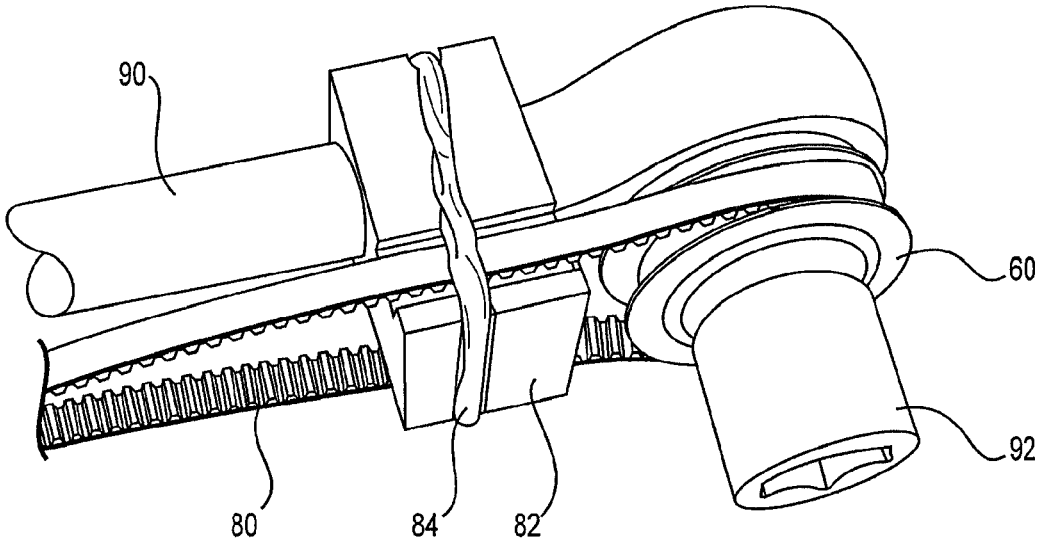

FIGS. 5-8 illustrate the use of pulley 60 in conjunction with a wrench 90. FIGS. 5-6 illustrate an unassembled high speed wrench system, having a well understood ratchet wrench 90, a socket 92, pulley 60, a belt 80, a first holding band 82 and a second holding band 84. These same components are illustrated as assembled in FIGS. 7-8. Again, the attachment of belt 80 allows for the high speed spinning of socket 92. In this embodiment, pulley 60 makes this function possible by incorporating a gear-like structure for interaction with belt 80. Although configured in a slightly different manner, first holding band 82 and second holding band 84 cooperate to contain belt 80 in the manner described above in relation to FIG. 1.

Figure 4:
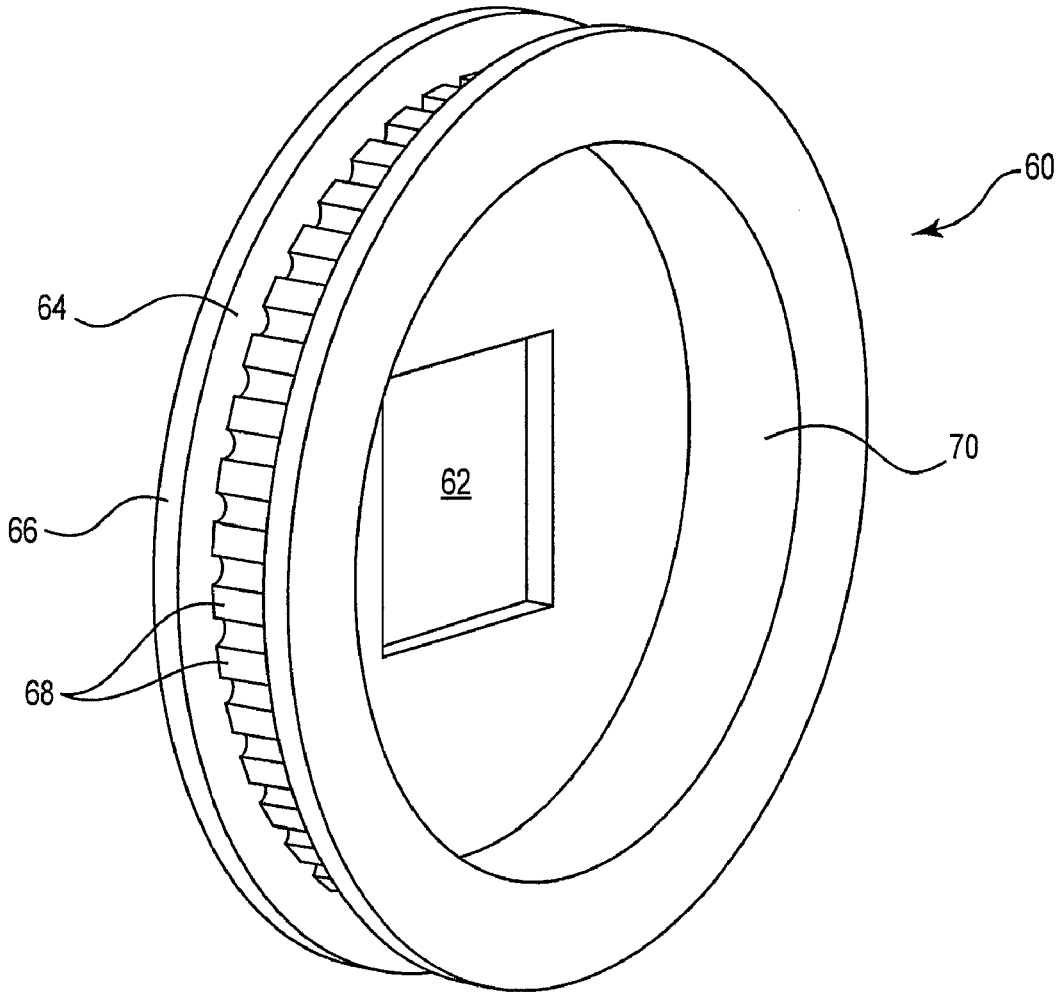
FIG. 4 shows a perspective view of the gear wheel attachment useable with standard socket wrenches.

Although FIG. 4 illustrates a separate detachable pulley, this structure could be incorporated into the wrench mechanism. For example, this could be created in a manner similar to the well understood thumb wheel, which is well accepted and used by those skilled in the art.

Figure 9:
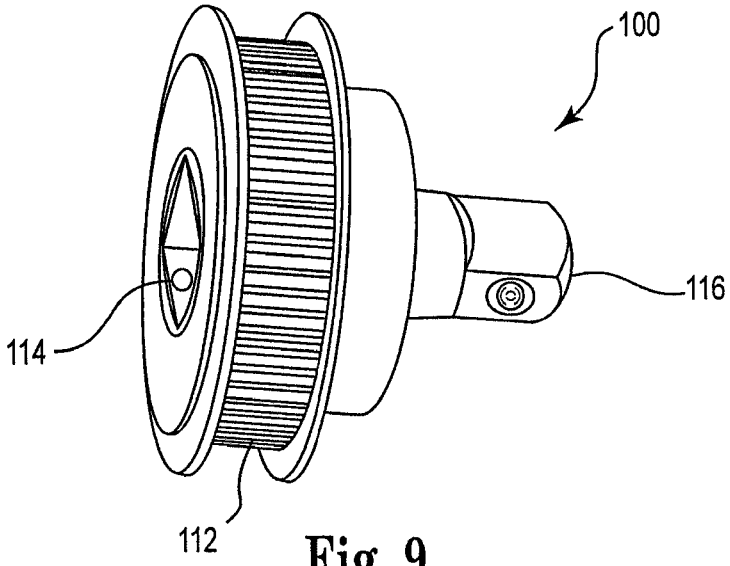
FIG. 9 shows a second embodiment of the gear wheel attachment concept.
Figure 10:
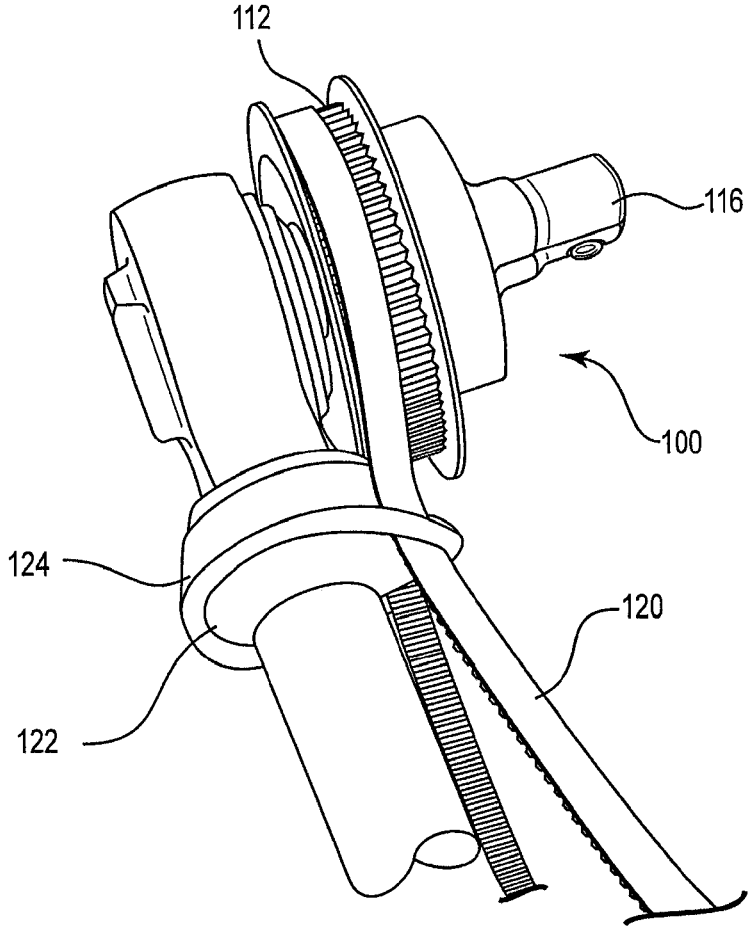
FIG. 10 illustrates the second embodiment as incorporated with a standard socket wrench.

Yet another implementation of the high speed drive is illustrated in FIGS. 9 & 10. FIG. 9 specifically illustrates an extension attachment 100 for use in conjunction with a standard socket wrench. Extension attachment 100 includes a disc shaped portion 110 with a recess 112 existing on a circumferential edge. Recess 112 is again configured to interact with a belt (not shown). One side of extension 100 includes a receptacle 114 designed to receive the drive shaft of a typical socket wrench. An opposite side of extension attachment 100 includes and extension drive shaft 116 configured for attachment to standard sockets.

Attachment extension 100 is illustrated in FIG. 10 as being attached to a standard socket wrench. As shown, a wrench 118 has extension attachment 100 connected thereto. Yet another belt 120 is attached to wrench 118 and extension attachment 100. Belt 120 is again contained by a first holding band 122 and a second holding band 124. These holding bands (122 & 124) also cooperate to contain belt 120 as discussed above.

Figure 11:
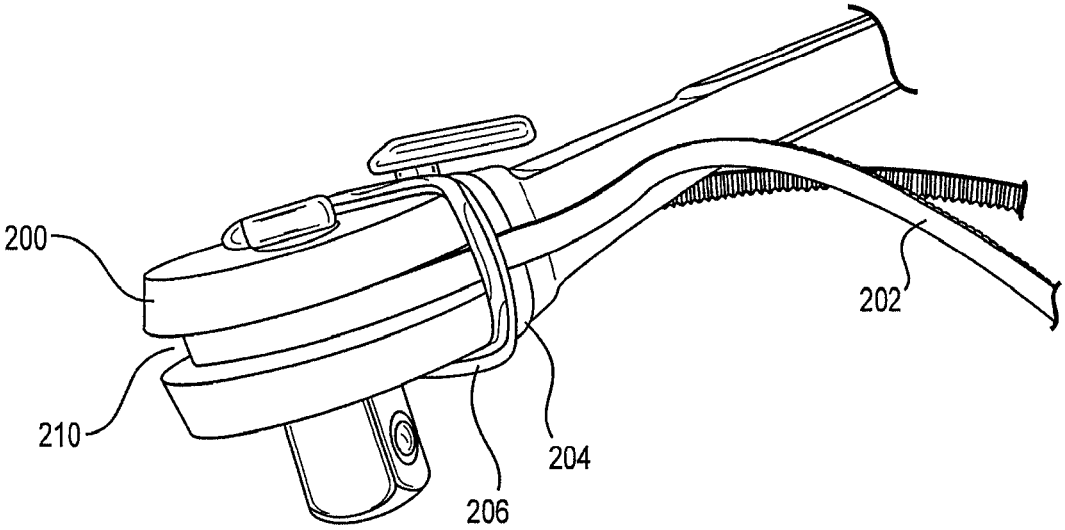
FIG. 11 illustrates yet another embodiment of the high speed attachment system utilized with specially configured socket wrench.

A further implementation of the belt drive concept is illustrated in FIG. 11. In this case, a wrench 200 again has a belt 202 attached thereto, and contained by a first holding band 204 and a second holding band 206. In this implementation however, the body of wrench 200 includes specific accommodations which allow belt 202 to interact with gear teeth (not show) contained within. More specifically, a groove 210 has been created at a top end of wrench 200, which exposes underlying gear teeth associated with the internal ratchet mechanism. Again, the holding bands will operate in a manner similar to those described above to contain belt 202 while also allowing movement.

Figure 12:
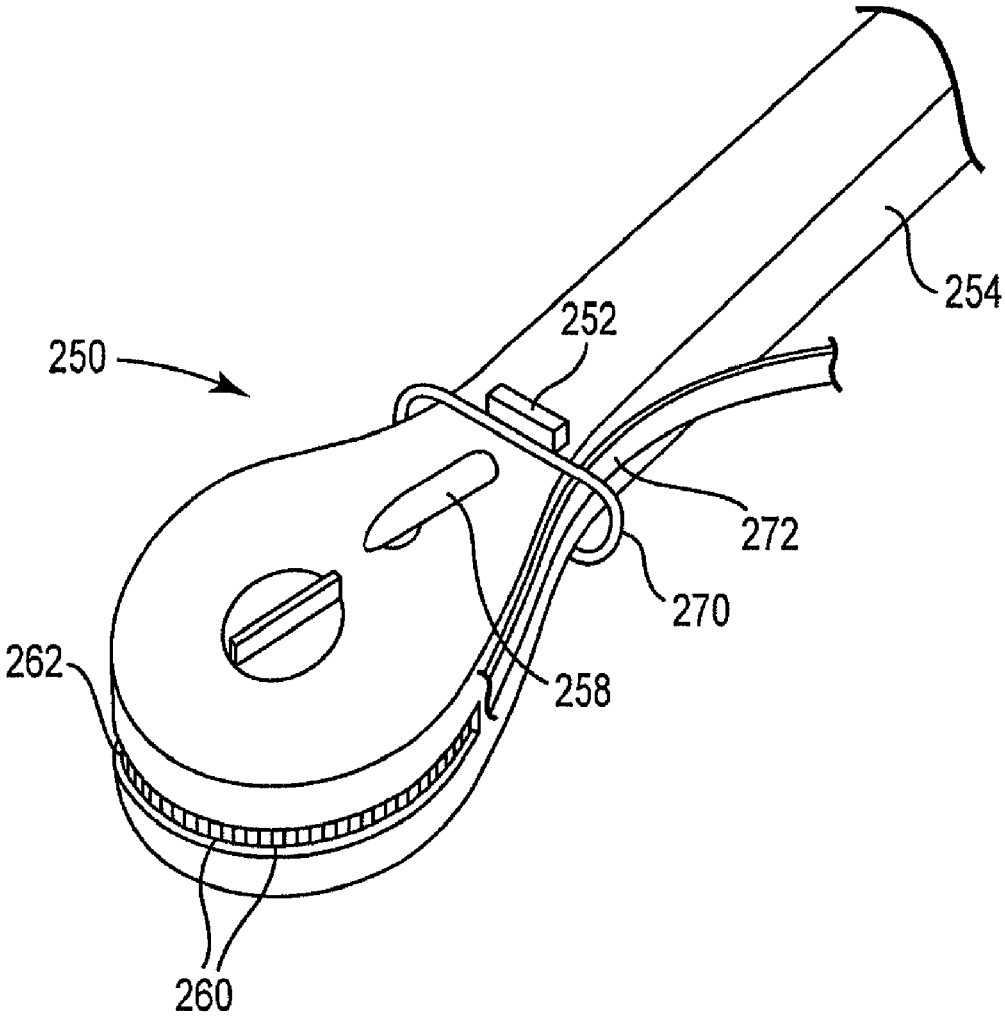
FIG. 12 provides a perspective view of an alternative embodiment also using a specifically configured socket wrench.

FIG. 12 shows yet another embodiment utilizing the principles of the present invention. This embodiment has a fairly standard socket wrench, which has been modified to include a slight ridge 252 which is used as a holding structure. More specifically, a wrench 250 contains the standard components such as a handle 254, a drive shaft 256, and a direction switch 258. Again, wrench 250 includes exposed gear teeth 260, which are accessible via a groove or slot 262 at the upper end of the wrench. In this embodiment, only a single holding band 270 is used to contain belt 272 (with only a portion of the belt being illustrated in this figure). Holding band 270 is again preferably configured to have a low friction surface thus allowing belt to easily slide. The presence of ridge 252 will keep holding band 270 will keep in position thus also keeping belt 272 in the proper orientation to engage exposed gear teeth 260 when pulled.

Figure 13:
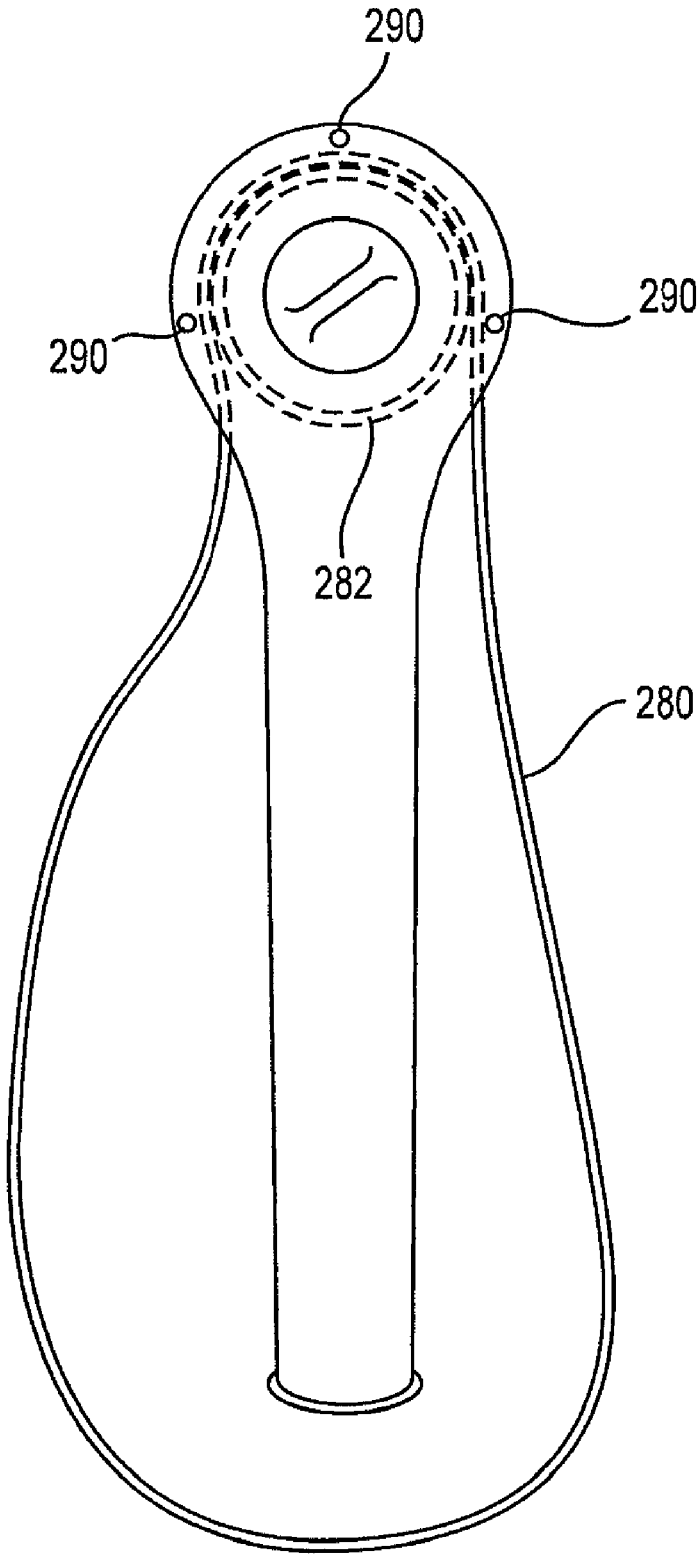
FIG. 13 is a front view of another embodiment wherein the belt is retained by pins in the ratchet head.

A further embodiment is illustrated in FIG. 13. Here the upper end of the ratchet wrench is exposed in a manner similar to that illustrated in FIGS. 11 and 12 above. In this configuration however, sufficient space is provided for a plurality of holding pins 290 to retain belt 280 in an appropriate position. Again, belt 280 again includes teeth on an inner surface thereof (similar to the embodiments outlined above). Further, belt 280 is sized appropriately to allow positioning adjacent an internal gear surface of drive mechanism 282 (as illustrated in dotted line format). It is contemplated that pins 290 are removably positioned within corresponding holes to allow for occasional replacement of belts. It is not likely that belt replacement would be required on a regular basis, therefore the connection or attachment of pins is intended to be relatively secure. For example threaded screws or press fit posts could be used. Naturally, many other securing methodologies would be equally applicable.

In the embodiment illustrated in FIG. 13, the holding bands or positioning bands are no longer present. Naturally, this avoids the possibility of interfering structures during use of the wrench. However, the use of pins 290 does require modification to the wrench, or the design of a specialized wrench structure. As such, this embodiment becomes slightly more involved and specialized, requiring modifications to the wrench body in numerous ways. While three holding pins 290 are illustrated in FIG. 13, any number of pins could be used. It is further noted however, that the pins on the right and left sides of the wrench head are preferably positioned slightly below the halfway line (i.e., the four o'clock and eight o'clock positions roughly). In this manner the belt will be positioned in a desired mating relationship with the drive structure within the wrench while also allowing the necessary freedom to slide or move appropriately.

Figure 14:
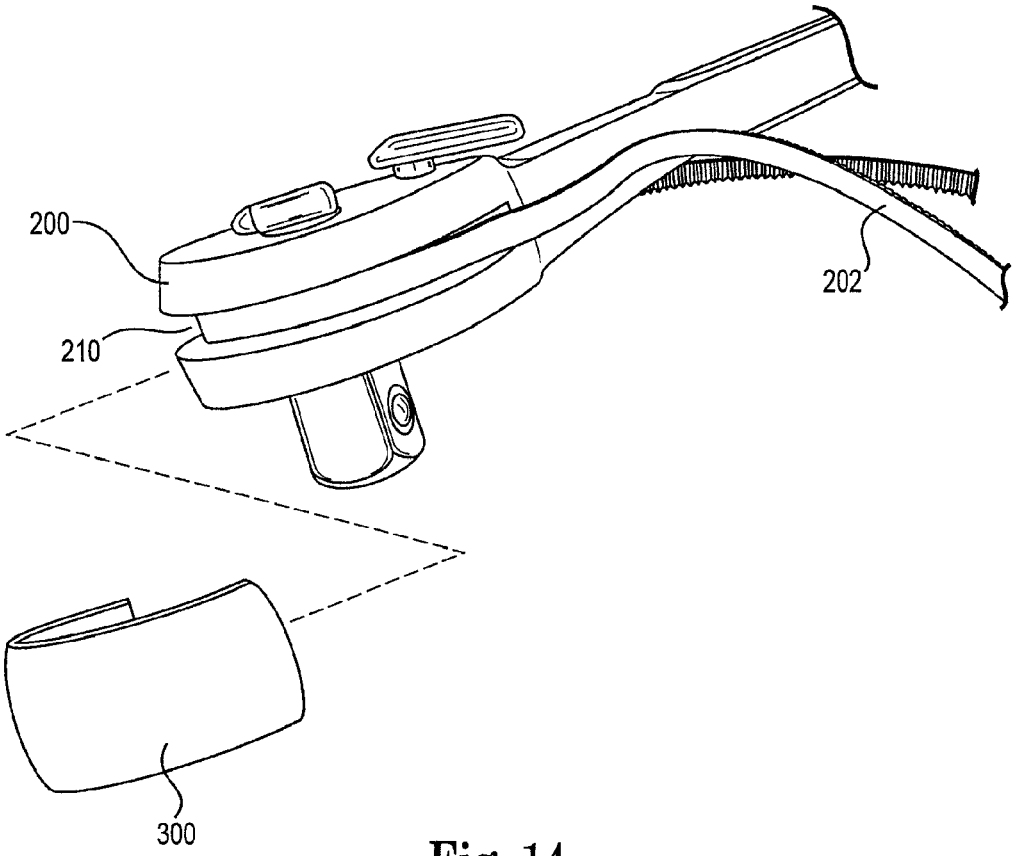
FIG. 14 is a perspective view of a further embodiment using a snap-on cap to contain the belt.

As the embodiment of FIG. 13 illustrates, there are various ways to hold the belt in an operative arrangement with the drive mechanism of the wrench. Using the same concepts as the pin structure illustrate, alternative structures could easily be used to appropriately capture the belt. For example, a snap-fit cap could be attached to the top surface of the wrench and enclose the groove which already exists. FIG. 14 illustrates the use of such a snap-fit cap 300 which is designed to fit over the end of wrench 200. When attached to wrench 200, snap-fit cap 300 will enclose groove 210, thus creating a defined path for belt 202. Once again, the containing and positioning bands are not needed in this embodiment. Snap-fit cap 300 could be made of metal, plastic, composite, or other materials which are rugged and appropriately pliable. It is anticipated that snap-fit cap 300 would be configured to surround more than ½ of the circular wrench head, thus allowing for secure attachment while also containing belt 202 in an appropriate manner. Stated alternatively, the end portions 302, 304 of snap-fit cap 300 would extend to approximately the 4 o'clock and 8 o'clock positions (using a clock face reference). In a similar manner, a smaller insert could be designed to occupy the space immediately adjacent the belt (i.e. fill the groove 210 which is occupied by pins 290 shown in FIG. 13). Such an insert may likely have a T-shaped cross-section so that a portion fills groove 210 while a portion sits adjacent the wrench end.

Although not shown above, those skilled in the art will recognize that yet another embodiment could incorporate a gear structure on an outer surface of the sockets. In this manner, the socket could be attached in a traditional manner, and have the belt appropriately positioned for desired interaction. These sockets could take a form somewhat similar to pulley 60 as illustrated in FIG. 4. Specifically, the socket would be designed to include a groove and underlying gear teeth capable of specifically interacting with the belt. This approach would be effective at providing high speed capabilities using necessary components.

As generally outlined above, the present invention utilizes a belt coupled to the drive mechanism of a ratchet style wrench to achieve high speed operation. The coupling or cooperation between the belt and the drive mechanism is generally achieved by the cooperative action of gears and a drive belt, held in a generally meshed or interfering relationship with one another. The meshed relationship is largely established when force is applied to the belt (i.e. the belt is pulled). The materials used to make up the belt, and the configuration of components enhance this operation. That said, it is only required to have the teeth loosely or generally mesh with the drive, and it is only required to have the belt loosely adjacent the drive teeth when not being used.

The variations discussed above highlight the fact that different approaches can be used to maintain the belt in a cooperational position with the drive of the wrench, thus allowing for high speed operation. Generally speaking, each of these embodiments cause the belt to be maintained in an appropriate alignment/position for the contemplated high speed operation of the wrench. Some approaches have distinct advantages, such as simplicity or ease of use. Others may avoid potentially interfering structures that could be a nuisance to the user. By first incorporating the appropriate structures to maintain the proper alignment/position, the wrench can then be operated at high speeds by simply pulling on the belt.

As generally described above, the belt drive concept allows well understood wrenches to be adapted in a manner to provide high speed operation. This functionality is provided in a manner which is straight forward and easily achieved. Although several embodiments and implementations have been described above, the belt drive concept can likely be modified in various ways without departing from the general spirit of the following claims.

The invention claimed is:

1. A system for high speed operation of a ratchet style wrench which has a handle portion and a spinning drive portion capable of engaging a fastener which is to be operated upon, the system comprising:

a continuous loop elongated drive belt having an inner surface and an outer surface, wherein the inner surface has an engaging structure thereon, and wherein the outer surface is substantially smooth;

a belt holding structure positioned to hold the belt in a desired orientation, wherein the belt holding structure is positioned outside the drive belt and adjacent to the substantially smooth outer surface so that the outer surface of the belt and the holding structure do not substantially interfere with one another as the belt is pulled, and wherein the holding structure causes a first portion of the drive belt to be held in operational contact with a portion of the drive structure of the wrench so that force can be applied by a user to a free end of the belt which is unattached to any portion of the wrench.

2. The system of claim 1 wherein the engaging structure of the drive belt includes a plurality of teeth configured in a recurring pattern.

3. The system of claim 2 wherein the drive belt is a timing belt.

4. The system of claim 1 wherein the ratchet style wrench to be operated at high speed is a box-end ratchet wrench with the drive portion having gear teeth exposed on an outer circumferential edge thereof, and wherein the engaging structure of the drive belt includes a plurality of teeth configured in a recurring pattern, wherein the belt teeth and the gear teeth create an interference coupling causing the drive portion to rotate when one side of the belt is pulled.

5. The system of claim 1 wherein the belt holding structure comprises a positioning element coupled to the body of the wrench to create an interfering structure at a predetermined location, and a belt holding element capturing the outer surface of the belt and interacting with the positioning element to hold the belt in the desired position on the wrench body.

6. The system of claim 5 wherein the positioning element is an elastic member having a relatively high coefficient of friction and which is tightly coupled around the handle portion to thereby hold its position.

7. The system of claim 5 wherein the positioning element is an integral structure formed in the handle portion thus creating a permanent interfering structure.

8. The system of claim 5 wherein the belt holding element is a cloth covered elastic band which surrounds the drive belt, wherein the cloth covered surface creates a low level of friction with the outer surface of the belt.

9. The system of claim 1 wherein the wrench has exposed teeth on an outer portion of the drive structure and the belt holding structure includes a snap-on cap covering the drive end of the wrench configured to contain the belt in a position adjacent the drive structure.

10. The system of claim 1 wherein the wrench has exposed teeth on an outer portion of the drive structure and the belt holding structure includes a plurality of pins attached to the wrench head in a manner and an appropriate position to retain the belt in a position adjacent the drive structure.

11. The system of claim 1 further comprising a pulley attached to the drive portion of the ratchet style wrench which includes an outer hub having an engagement surface, and wherein the engaging structure of the drive belt includes a plurality of teeth configured in a recurring pattern, the belt teeth and the engagement surface creating an interference coupling causing the drive portion to rotate when one side of the belt is pulled.

12. The system of claim 1 wherein the ratchet style wrench is a socket type wrench having an opening at a head end thereof to provide access to an internal gear structure, and wherein the engaging structure of the drive belt includes a plurality of teeth configured in a recurring pattern, the belt teeth and the gear teeth creating an interference coupling causing the drive portion to rotate when one side of the belt is pulled.

13. The system of claim 1 further comprising a pulley extension device attached to a drive shaft of the drive portion of the ratchet style wrench which includes an outer hub having an engagement surface and which has an engagement shaft extending in an opposite direction, and wherein the engaging structure of the drive belt includes a plurality of teeth configured in a recurring pattern, the belt teeth and the engagement surface creating an interference coupling causing the drive portion to rotate when one side of the belt is pulled.

14. A wrench capable of attaching and removing fasteners using both a high torque mode and a high speed mode, the wrench comprising:

a wrench body having a handle and an end portion;

a ratcheted drive at the end portion of the wrench body, capable of spinning in a first direction relative to the handle with relatively low resistance while not being able to spin in the opposite direction relative to the handle, the ratcheted drive further capable of engaging with the fastener;

a continuous belt having a portion engaged with the ratcheted drive, a portion adjacent opposite sides of the handle and a portion which is free hanging;

a holding structure positioned on the handle and adjacent to the end portion, the holding structure extending outwardly from a portion of the handle to create an interfering structure; and a containing band surrounding the handle portion and the belt, the containing band positioned adjacent the holding structure on a side closer the ratcheted drive than the holding structure thereby preventing the containing band from sliding on the handle in a direction away from the end portion.

15. The wrench of claim 14 wherein the holding structure is an elastic band placed on the handle, the elastic band being sufficiently sized to tightly attach to the handle.

16. The wrench of claim 14 wherein the holding structure is a permanently attached extension member.

17. The wrench of claim 14 wherein the ratcheted drive includes exposed gear teeth at the end portion of the wrench, and wherein the belt is engaged with the drive by having the belt in direct contact with the exposed gear teeth.

18. The wrench of claim 17 wherein the wrench body and the ratcheted drive are part of a closed end ratchet wrench.

19. The wrench of claim 18 wherein the wrench body and the ratcheted drive are part of a ratcheted socket wrench.

20. The wrench of claim 14 wherein the ratcheted drive includes a drive extension and a pulley attached to the drive extension, the pulley being disk shaped and having exposed teeth at a circumferential edge thereof, and wherein the belt is engaged with the drive by having the belt in direct contact with the exposed teeth.

21. The wrench of claim 20 wherein a socket is attachable to the drive extension.

22. A conversion kit which provides a ratchet wrench with the ability to achieve high speed rotation of a ratchet drive structure, the conversion kit comprising:

a continuous loop drive element having an engagement structure configured to engage a corresponding structure on the ratchet drive structure; and a holding mechanism for holding the drive element in engagement with the ratchet drive structure while also allowing a remaining portion of the continuous loop drive element to be easily accessible by a user, wherein the continuous loop drive element is engaged at only one end of the loop.

23. The conversion kit of claim 22 wherein the continuous loop drive element is a timing belt.

24. The conversion kit of claim 22 wherein the continuous loop drive element is a chain.

25. The conversion kit of claim 22 wherein the loop is guided onto a gear or pulley that could be a part of a tool or an addition to a tool for removing fasteners.

* * * * *